US010449595B2

(12) United States Patent
Otsubo et al.

(10) Patent No.: US 10,449,595 B2
(45) Date of Patent: Oct. 22, 2019

(54) PROTRUSION FORMING DEVICE AND METHOD FOR FORMING PROTRUSION PART FOR HEAT EXCHANGER

(71) Applicant: DENSO CORPORATION, Kariya, Aichi-pref. (JP)

(72) Inventors: Hidemasa Otsubo, Kariya (JP); Masahiro Shimoya, Kariya (JP); Yoshinobu Hayakawa, Kariya (JP); Kengo Takeshita, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 505 days.

(21) Appl. No.: 15/342,394

(22) Filed: Nov. 3, 2016

(65) Prior Publication Data

US 2017/0050233 A1 Feb. 23, 2017

Related U.S. Application Data

(62) Division of application No. 13/752,870, filed on Jan. 29, 2013, now abandoned.

(30) Foreign Application Priority Data

Feb. 1, 2012 (JP) ..... 2012-019637

(51) Int. Cl.
*B21D 53/02* (2006.01)
*B21J 5/12* (2006.01)
(Continued)

(52) U.S. Cl.
CPC ..... *B21D 53/022* (2013.01); *B21J 5/12* (2013.01); *F28F 1/04* (2013.01); *F28F 3/022* (2013.01); *F28F 3/048* (2013.01)

(58) Field of Classification Search
CPC .... B21D 53/02; B21D 53/022; B21D 53/025; B21D 28/28; B21J 5/12; B21C 37/22;
(Continued)

(56) References Cited

U.S. PATENT DOCUMENTS 2,607,249 A * 8/1952 Johnston ..... B21D 1/06 72/409.01
3,557,407 A * 1/1971 Lemelson ..... B21C 37/02 264/162

(Continued)

FOREIGN PATENT DOCUMENTS

JP 2009-032755 A 2/2009

OTHER PUBLICATIONS

Shamoto, Eiji, et al., "Studies on Continuous Chip Disposal and Chip-Pulling Cutting—Challenge to Chip Control by Changing Shape of Rake Face-".

(Continued)

*Primary Examiner* — Gregory D Swiatocha
(74) *Attorney, Agent, or Firm* — Harness, Dickey & Pierce, P.L.C.

(57) ABSTRACT

A protrusion forming device includes a holding portion holding an object that is be processed, a tool bit having a cutting portion capable of cutting an object held by a holding portion, and a drive portion capable of driving the tool bit. The tool bit is movable along a cut-in pathway so that the cutting portion is inserted into the object. The cutting portion is movable along a further-cut pathway so as to form a protrusion part that is cut in a linear shape and is connected to the object. The tool bit continuously contacts the protrusion part while moving along a forming pathway such that the protrusion part extends perpendicular to an outer surface of the object.

6 Claims, 11 Drawing Sheets

(51) Int. Cl.
*F28F 3/02* (2006.01)
*F28F 1/04* (2006.01)
*F28F 3/04* (2006.01)

(58) Field of Classification Search
CPC ..... F28F 1/12; F28F 1/04; F28F 3/048; F28F 3/022; F28F 2001/428; H05K 7/20; B23D 79/06; B23P 23/04
USPC ..... 72/325; 29/890.05; 165/161; 83/862
See application file for complete search history.

(56) References Cited

U.S. PATENT DOCUMENTS 3,753,364 A * 8/1973 Runyan ..... B21C 37/207 72/71
3,886,639 A * 6/1975 Pasternak ..... B21D 31/00 165/181
3,892,123 A * 7/1975 Baldwin ..... B21D 1/00 29/402.19
4,018,076 A * 4/1977 Wagner ..... B21D 1/06 72/457
4,249,949 A * 2/1981 Wooler ..... C02F 11/008 588/8
5,146,979 A * 9/1992 Zohler ..... B21C 37/207 165/133
6,427,767 B1 * 8/2002 Mougin ..... F28F 1/36 165/133
6,553,869 B1 * 4/2003 MacKelvie ..... B23D 63/06 76/112
7,249,483 B2 * 7/2007 Pham ..... B21J 5/12 72/325
7,320,177 B2 * 1/2008 Miyahara ..... F28F 3/04 257/E23.103
2006/0228184 A1 * 10/2006 Jung ..... B21J 5/12 409/297
2009/0025222 A1 1/2009 Miyahara
2009/0220311 A1 9/2009 Shamoto et al.
2011/0027605 A1 * 2/2011 Horng ..... B32B 15/08 428/575
2012/0103150 A1 * 5/2012 Fukuoka ..... B23B 3/162 29/27 C
2013/0167704 A1 * 7/2013 Swinford ..... B21J 5/12 83/862

OTHER PUBLICATIONS

Office Action dated Mar. 7, 2014 in corresponding Japanese Application No. 2012-019637.

* cited by examiner

PROTRUSION FORMING DEVICE AND METHOD FOR FORMING PROTRUSION PART FOR HEAT EXCHANGER

CROSS REFERENCE TO RELATED APPLICATION

This application is a divisional application of U.S. patent application Ser. No. 13/752,870 filed on Jan. 29, 2013, which claims the benefit and priority of Japanese Patent Application No. 2012-019637, filed Feb. 1, 2012. The entire disclosures of each of the above applications are incorporated herein by reference.

TECHNICAL FIELD

The present disclosure relates to a protrusion forming device and a method for forming a protrusion part for a heat exchanger.

BACKGROUND

A method is known, which is for forming a protrusion part connected to an object by cutting (i.e., shaping) the object without separating the protrusion part from the object. In shaping process, the protrusion part is generally shaped so as to be rolled back, in order to increase a cutting efficiency. For example, Patent Document 1 (JP 2009-32755 A corresponding to US 2009/0025222 A1) discloses a method for forming a platy heat radiation fin that is a protrusion part rolled back.

When the rolled-back protrusion part is used as a heat radiation fin, air between the radiation fins is difficult to be exchanged for outer air. Thus, a cooling capacity of the heat radiation fin may be relatively small.

SUMMARY

It is an objective of the present disclosure is to provide a protrusion forming device capable of forming a protrusion part extending perpendicular to an outer surface of an object, to provide a method for forming the protrusion part, and to provide a heat exchanger having the protrusion part formed by the protrusion forming device or the method for forming the protrusion part.

According to an aspect of the present disclosure, a protrusion forming device includes a holding portion, a tool bit and a drive portion. The holding portion holds an object that is to be processed, and the tool bit has a cutting portion capable of cutting the object. The tool bit is movable along a cut-in pathway intersecting with an outer surface of the object so that the cutting portion of the tool bit is inserted into the object. The cutting portion is inserted into the object is movable along a further-cut pathway parallel to the outer surface of the object so as to provide a protrusion part that is cut in a linear shape and is connected to the object. The tool bit continuously contacts the protrusion part while moving along a predetermined forming pathway such that the protrusion part extends perpendicular to the outer surface of the object.

According to another aspect of the present disclosure, a method is provided, which is for forming a protrusion part extending perpendicular to an outer surface of an object that is to be processed. According to the method, a tool bit is moved along a cut-in pathway intersecting with the outer surface of the object so that a cutting portion of the tool bit is inserted into the object. Moreover, the cutting portion inserted into the object is further moved along a further-cut process parallel to the outer surface of the object so as to form a protrusion part that is cut in a linear shape and is connected to the object. Furthermore, the tool bit is moved along a predetermined forming pathway while keeping the tool bit in contact with the protrusion part.

Accordingly, the protrusion part extending perpendicular to the outer surface of the object can be formed by cutting work. When the protrusion part extending perpendicular to the outer surface is used as a heat radiation fin, a high heat cooling capacity can be obtained.

In the present specification, a word "direction" includes a linear direction and a curved direction. Thus, the "direction intersecting with the protrusion part" includes a linear direction intersecting with the protrusion part perpendicularly, a linear direction inclined from a longitudinal direction of the protrusion part, and a circumferential direction of a circle that is drawn by using the base end portion of the protrusion part as a center of the circle.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
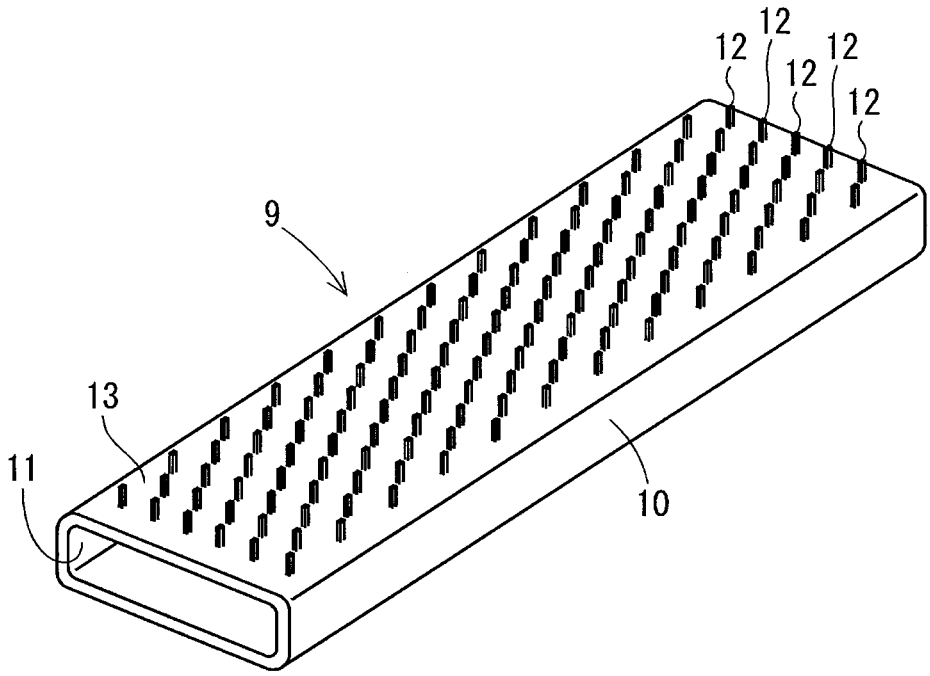
FIG. 1 is a perspective view showing a passage member having heat radiation fins formed by a protrusion forming device according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2:
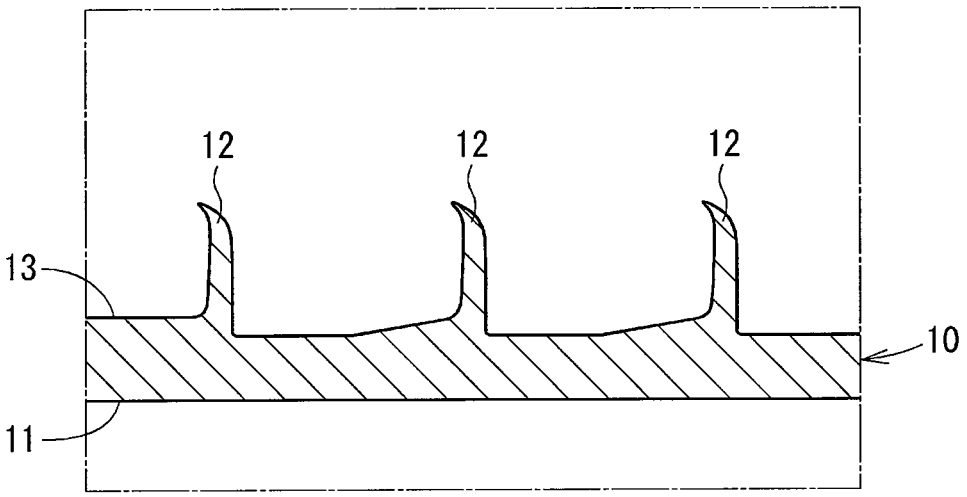
FIG. 2 is a sectional view showing a part of the passage member in FIG. 1.
Figure 3:
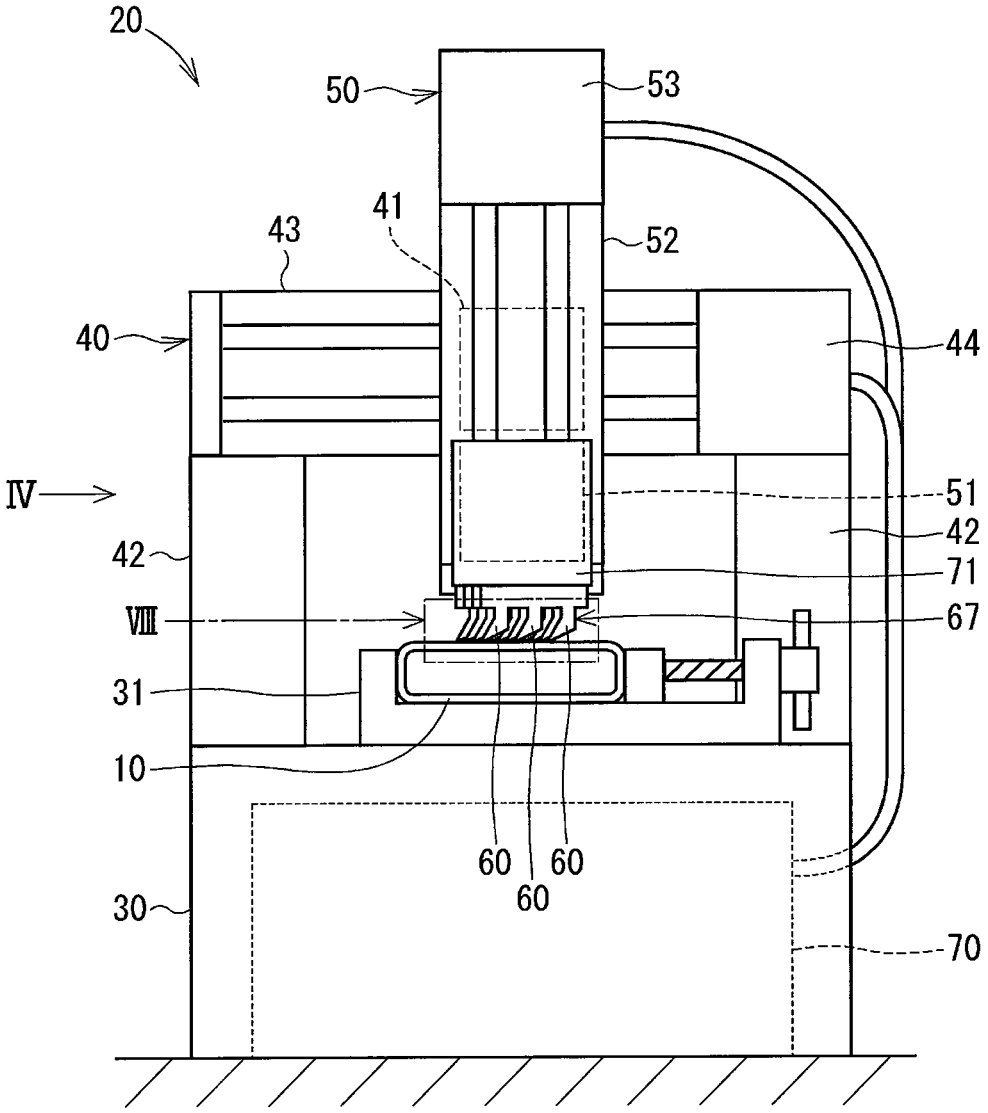
FIG. 3 is a diagram showing the protrusion forming device according to the first embodiment.
Figure 4:
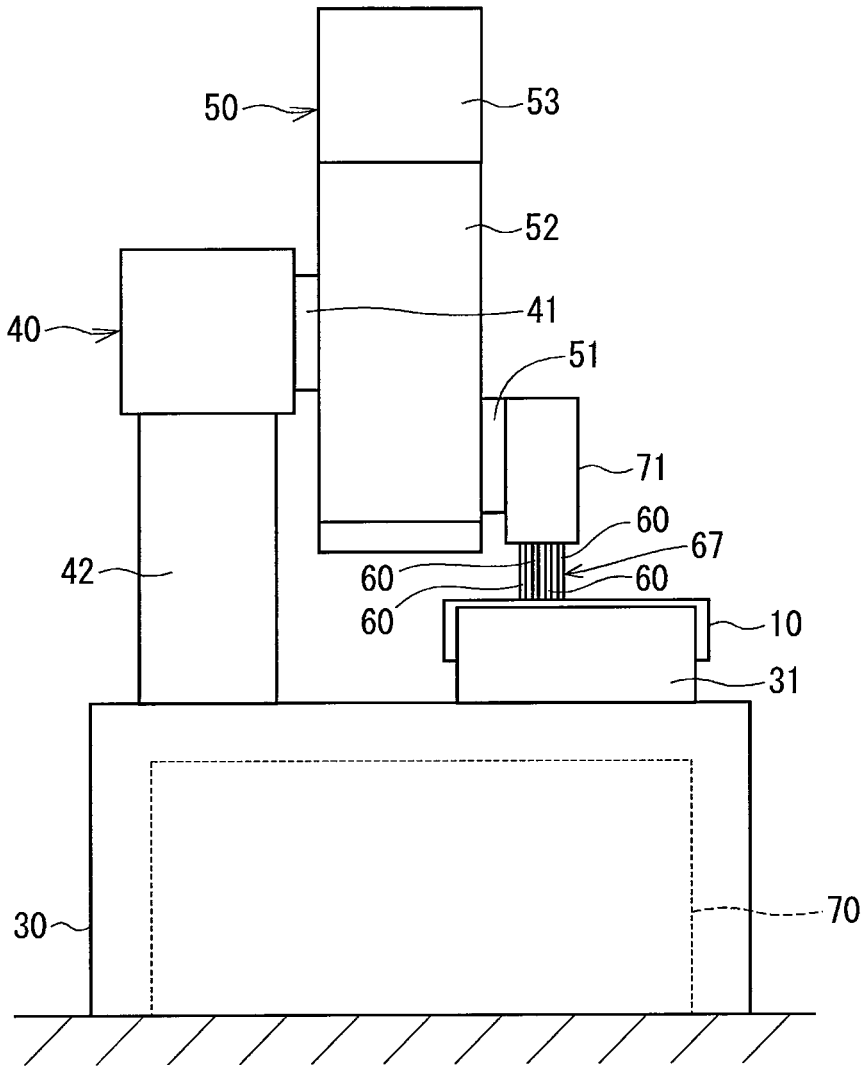
FIG. 4 is a diagram showing the protrusion forming device viewed from IV in FIG. 3.

A protrusion forming device 20 according to a first embodiment of the present disclosure, shown in FIGS. 3 and 4, forms heat radiation fins 12 of a passage member 10 shown in FIG. 1. The passage member 10 used for a heat exchanger 9 may be a cylindrical hollow member, and has therein, for example, a passage 11 through which a cooling medium such as coolant is capable of flowing. Heat of the cooling medium in the passage 11 transfers to the passage member 10 to be radiated from the heat radiation fins 12 to ambient air. As shown in FIG. 2, the heat radiation fins 12 are needle-like protrusion parts that extend perpendicular to an outer surface 13 of the passage member 10.

The protrusion forming device 20 will be described with reference to FIGS. 3 to 6. The protrusion forming device 20 includes a base 30, a vise 31, a drive portion and tool bits 60. The drive portion includes an x-axis actuator 40, a y-axis actuator 50 and an electronic control device 70. The vise 31 may be used as an example of a holding portion which holds an object that is to be processed by the protrusion forming device.

The vise 31 is fixed on a board of the base 30, and holds the passage member 10 that is used as an example of the processed object. The x-axis actuator 40 includes a slider 41 that is slidable in an x-axial direction parallel to a surface of the board of the base 30. The x-axis actuator 40 is supported by a pole 42 to be fixed to the base 30 as shown in FIG. 4. The slider 41 is, for example, fixed to a ball screw that is provided rotatably in a case 43. When the ball screw is rotary-driven by a motor 44, the slider 41 can be moved in the x-axial direction. The passage member 10 is held by the vise 31 so that the outer surface 13 on an upper side of the passage member 10 becomes parallel to the x-axial direction. The passage member 10 is held by the vise 31 horizontally in the first embodiment, as shown in FIGS. 3 to 6.

The y-axis actuator 50 includes a slider 51 that is slidable in a y-axial direction perpendicular to the board surface of the base 30. The slider 51 is, for example, fixed to a ball screw that is provided rotatably in a case 52. When the ball screw is rotary-driven by a motor 53, the slider 51 can be moved in the y-axial direction. The case 52 is fixed to and integrated with the slider 41 of the x-axis actuator 40 to be slidable in the x-axial direction together with the motion of the slider 41 in the x-axial direction.

Each tool bit 60 includes a support portion 61 and a cutting portion 62 that protrudes from one end part of the support portion 61. The cutting portion 62 protrudes in a direction intersecting with a longitudinal direction of the support portion 61. The cutting portion 62 is capable of cutting the passage member 10. A rake angle θ of a rake face 63 of the cutting portion 62 is set larger than a rake angle of a rake face of a cutting portion of a general shaper used for cutting a flat surface. The rake angle θ is an angle of the rake face 63 with respect to a line perpendicular to the outer surface 13 of the passage member 10 as shown in FIG. 5.

Figure 5:
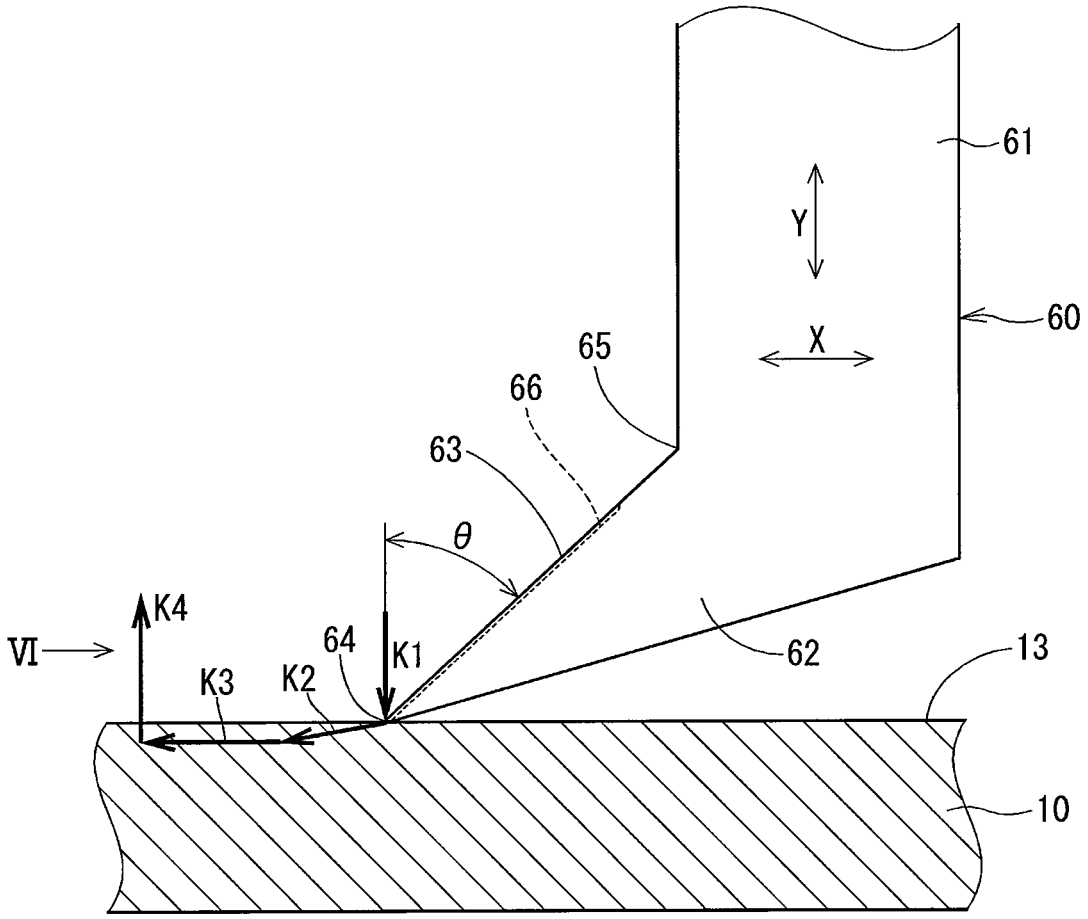
FIG. 5 is an enlarged diagram showing a cutting portion of a tool bit for the protrusion forming device in FIG. 3.
Figure 6:
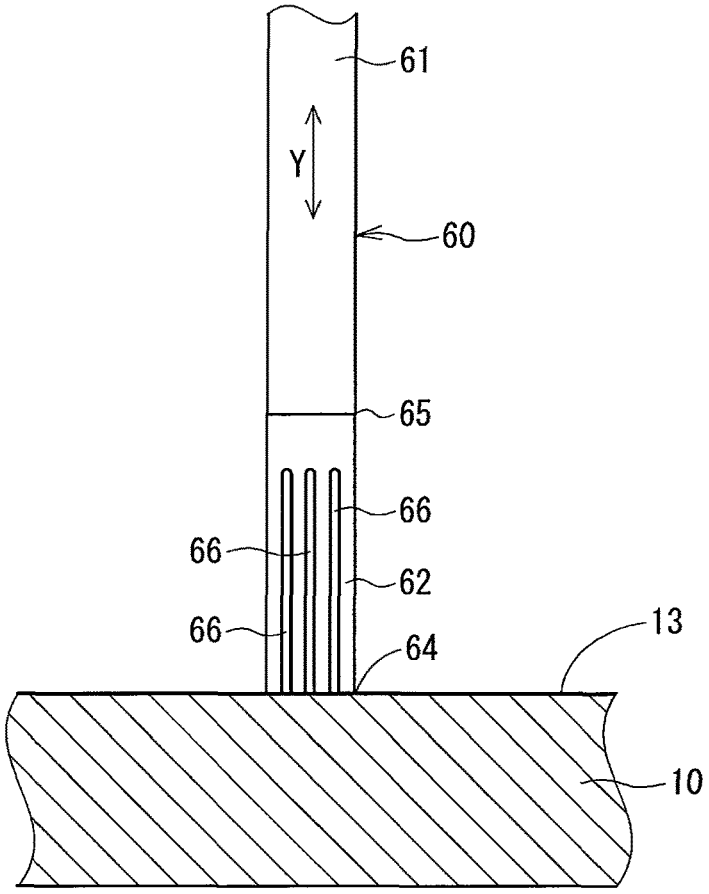
FIG. 6 is a diagram showing the cutting portion of the tool bit viewed from VI in FIG. 5.

The rake face 63 of the tool bit 60 has multiple grooves 66 that extend from an edge 64 toward a base end 65 of the tool bit 60 as shown in FIG. 5. The base end 65 is located at a connection portion between the cutting portion 62 and the support portion 61. The grooves 66 are separated from one another in a width direction of the tool bit 60, and are parallel to each other. The width direction of the tool bit 60 is perpendicular to the x-axial direction and the y-axial direction.

The other end parts of the support portions 61 of the tool bits 60 are connected to each other in the x-axial direction to be a cutting tool 67 having a platy shape. In the first embodiment, the cutting tool 67 is made of three tool bits 60, for example.

The protrusion forming device 20 has a plurality of the cutting tools 67 arranged in the width direction of the tool bit 60. In the first embodiment, the protrusion forming device 20 includes four cutting tools 67, for example. As shown in FIG. 3, the cutting tools 67 are held by a chuck device 71 fixed to the slider 51, so that the edges 64 of the tool bits 60 of one of the cutting tools 67 do not overlap the edges 64 of the tool bits 60 of another one of the cutting tools 67 in the width direction of the tool bits 60, i.e., in an arrangement direction (thickness direction) of the cutting tools 67.

The tool bits 60 move in the y-axial direction together with the slider 51 when the slider 51 moves in the y-axial direction. The tool bits 60 move in the x-axial direction together with the slider 41 and the y-axis actuator 50 when the slider 41 moves in the x-axial direction.

The electronic control device 70 has a microcomputer that includes a central processing unit (CPU), a read-only memory (ROM) and a random access memory (RAM). The electronic control device 70 operates the motors 44 and 53 based on a predetermined control program stored in the ROM to control a position of the tool bits 60 in the x-axial direction and the y-axial direction.

Specifically, the electronic control device 70 operates the motors 44 and 53, thereby being capable of displacing the tool bits 60 along an approaching pathway K1, a cut-in pathway K2, a further-cut pathway K3 and a first forming pathway K4. As shown in FIG. 5, the approaching pathway K1 extends downward in a direction perpendicular to the outer surface 13 of the passage member 10. An end point of the approaching pathway K1 is located immediately above a position where the edge 64 of the tool bit 60 contacts the outer surface 13.

As shown in FIG. 5, the end point of the approaching pathway K1 is used as a start point of the cut-in pathway K2, and the cut-in pathway K2 extends downward in a cut-in direction that is inclined at a predetermined angle (e.g., 10°) with respect to the outer surface 13 of the passage member 10. An end point of the cut-in pathway K2 is located inside the passage member 10.

As shown in FIG. 5, the end point of the cut-in pathway K2 is used as a start point of the further-cut pathway K3. The further-cut pathway K3 extends along a direction parallel to the outer surface 13 of the passage member 10, and extends along a direction from the base end 65 to the edge 64 of the tool bit 60. An end point of the further-cut pathway K3 is used as a start point of the first forming pathway K4, and the first forming pathway K4 extends upward in the direction perpendicular to the outer surface 13 of the passage member 10, as shown in FIG. 5. In other words, the first forming pathway K4 extends in a direction away from the outer surface 13 of the passage member 10.

Figure 7:
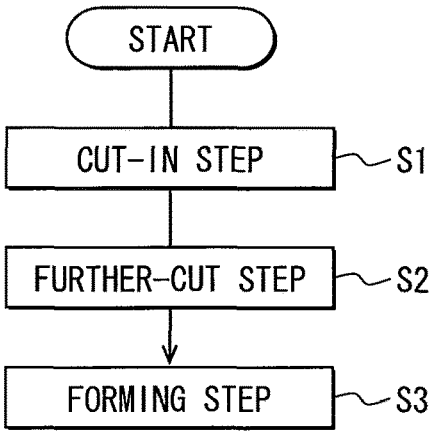
FIG. 7 is a flowchart showing a process for forming the heat radiation fin in the protrusion forming device according to the first embodiment.

Next, a method for forming the heat radiation fins 12 by using the protrusion forming device 20 will be described referring to FIGS. 7 to 11. As shown in FIG. 7, the method for forming the heat radiation fins 12 includes a cut-in step S1, a further-cut step S2 and a forming step S3.

Figure 8:
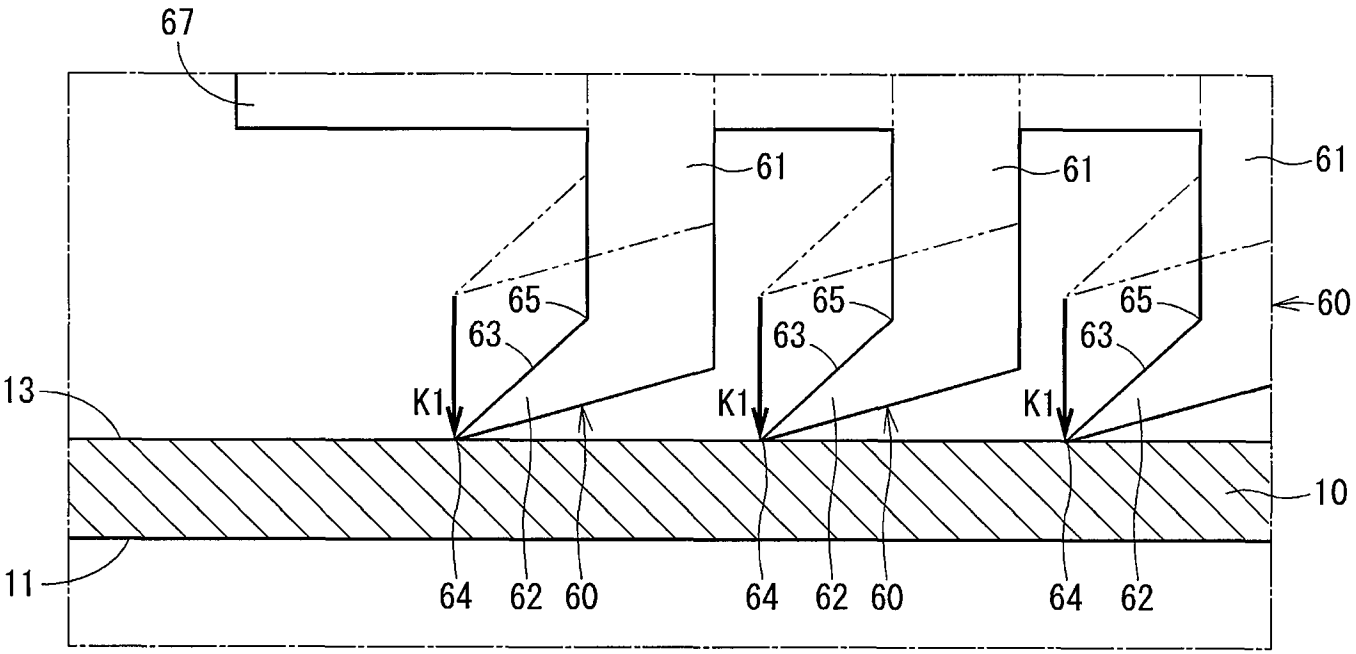
FIG. 8 is a diagram showing the tool bits moved so that the tool bits become adjacent to the passage member, viewed from VIII in FIG. 3.
Figure 9:
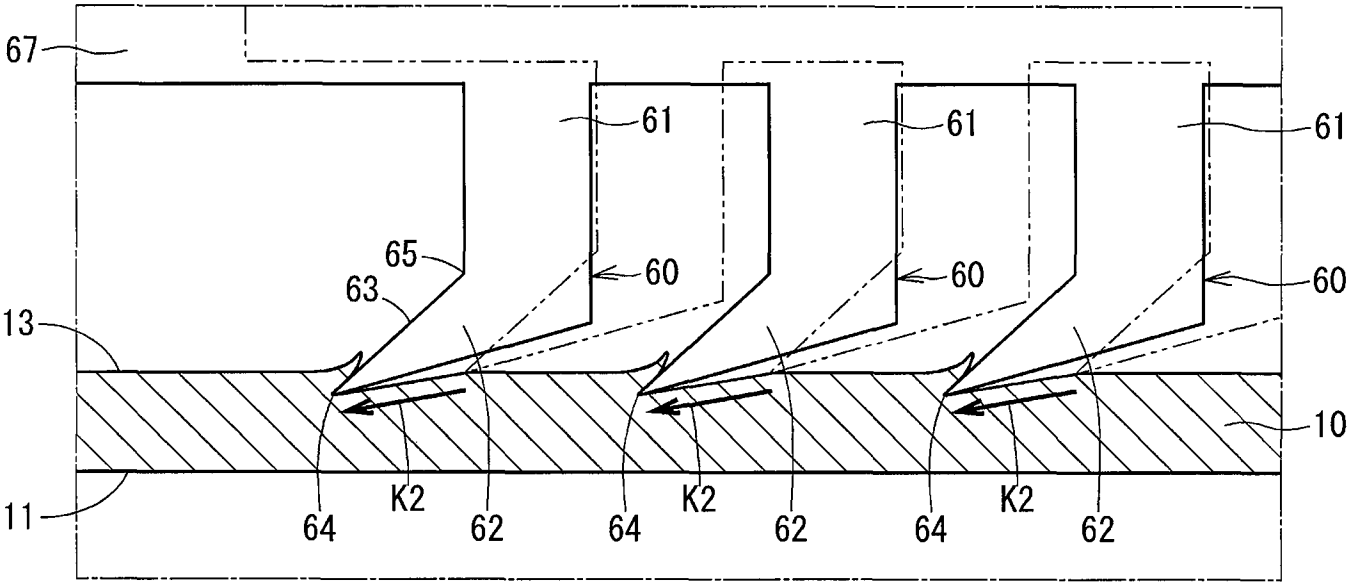
FIG. 9 is a diagram showing the tool bits moved from a state of FIG. 8 so that the tool bits are inserted into the passage member.

Firstly, at the cut-in step S1, the protrusion forming device 20 displaces the tool bits 60 along the approaching pathway K1 as shown in FIG. 8, so that the edges 64 of the tool bits 60 become in the vicinity of the outer surface 13 of the passage member 10. Subsequently, the protrusion forming device 20 displaces the tool bits 60 along the cut-in pathway K2 as shown in FIG. 9, so that the edges 64 of the tool bits 60 are inserted into the passage member 10. A cutting edge angle of the tool bits 60 with respect to the outer surface 13 is set at 10°, for example.

Figure 10:
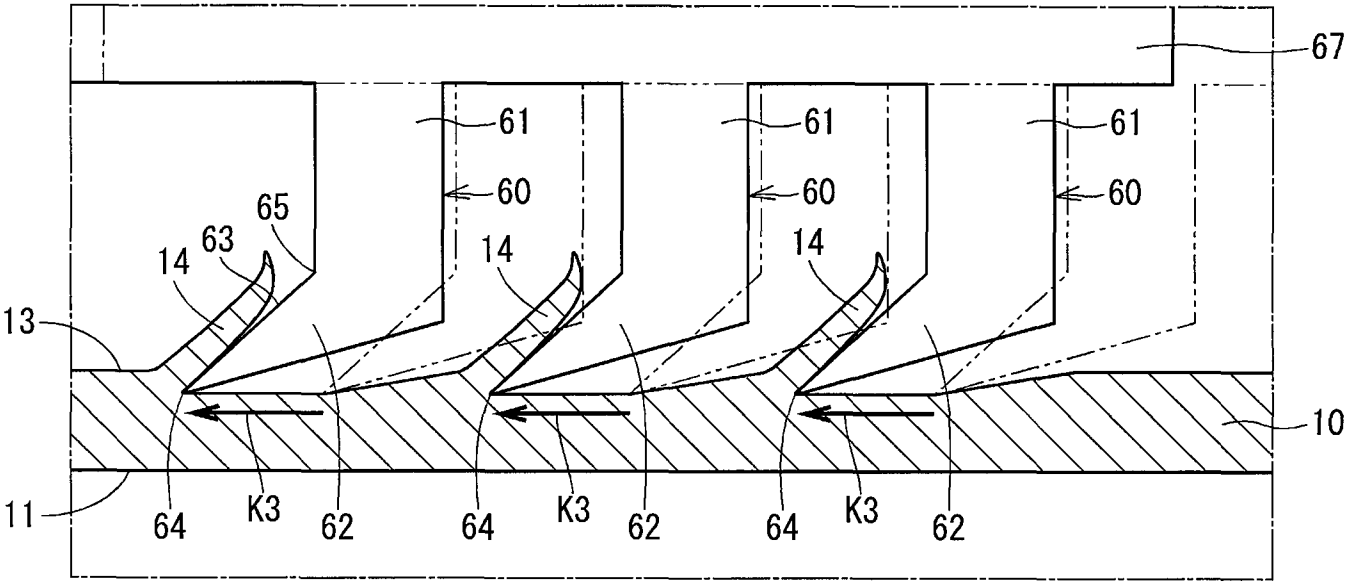
FIG. 10 is a diagram showing the tool bits moved from a state of FIG. 9 along a further-cut pathway.

Next, at the further-cut step S2 shown in FIG. 7, the protrusion forming device 20 displaces the tool bits 60, which are inserted into the passage member 10, along the further-cut pathway K3 as shown in FIG. 10. Accordingly, linear cut parts 14 (protrusion parts) connected to the passage member 10 are provided. When the edges 64 of the tool bits 60 are located at the end point of the further-cut pathway K3, the cut parts 14 extend along the rake faces 63 of the tool bits 60, and are not perpendicular to the outer surface 13 of the passage member 10.

Figure 11:
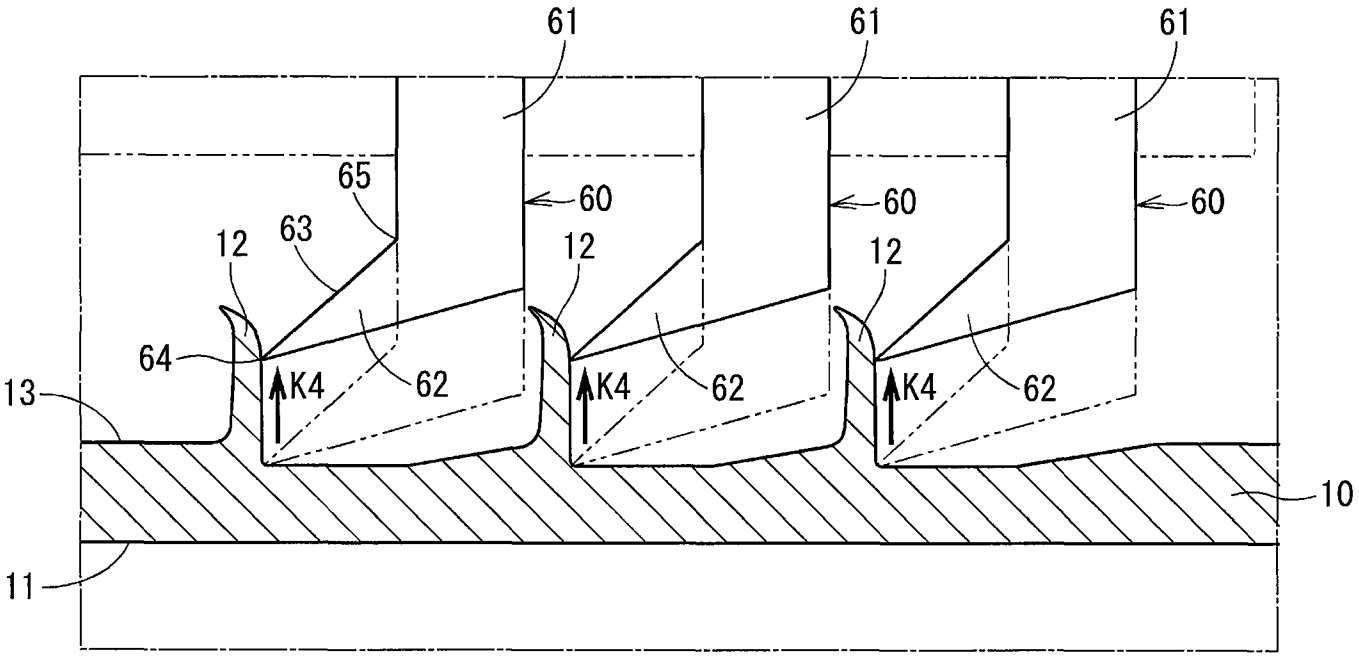
FIG. 11 is a diagram showing the tool bits moved from a state of FIG. 10 along a first forming pathway.

Next, at the forming step S3 shown in FIG. 7, the protrusion forming device 20 displaces the tool bits 60 along the first forming pathway K4 with the tool bits 60 kept in contact with the cut parts 14, as shown in FIG. 11. At this step S3, the edges 64 of the tool bits 60 slide on base end portions of the cut parts 14 to bend the base end portions so that the cut parts 14 are formed to be the heat radiation fins 12 extending perpendicular to the outer surface 13. The base end portion of the cut part 14 is directly connected to the outer surface 13. The first forming pathway K4 starts from a position adjacent to the base end portion of the cut part 14.

As described above, the protrusion forming device 20 of the first embodiment includes the tool bits 60, the x-axis actuator 40, the y-axis actuator 50 and the electronic control device 70. The electronic control device 70 is capable of operating the motor 44 of the x-axis actuator 40 and the motor 53 of the y-axis actuator 50, and thereby displacing the tool bits 60 along the approaching pathway K1, the cut-in pathway K2, the further-cut pathway K3 and the first forming pathway K4.

The electronic control device 70 displaces the tool bits 60 along the cut-in pathway K2 so that the cutting portions 62 of the tool bits 60 are inserted into the passage member 10. Next, the electronic control device 70 displaces the tool bits 60, which are inserted into the passage member 10, along the further-cut pathway K3 so as to provide the linear cut parts 14 connected to the passage member 10. Subsequently, the electronic control device 70 displaces the tool bits 60 along the first forming pathway K4 with the tool bits 60 kept in contact with the cut parts 14. Accordingly, the edges 64 of the tool bits 60 slide on and bend the base end portions of the cut parts 14, so that the cut parts 14 can be formed to be the heat radiation fins 12 extending perpendicular to the outer surface 13.

According to the protrusion forming device 20 and the protrusion forming method using the protrusion forming device 20, the radiation fins 12 extending perpendicular to the outer surface 13 of the passage member 10 can be formed by cutting work. Therefore, the heat radiation fins 12 having a high cooling capacity can be obtained.

In the first embodiment, the rake face 63 of each tool bit 60 has the grooves 66 that extend from the edge 64 to the base end 65 of the tool bit 60. Hence, it can be restricted that the cut parts 14 are bend in the width direction of the tool bit 60. Therefore, the heat radiation fins 12 having a high cooling capacity can be obtained.

In the first embodiment, the passage member 10 may have the passage 11 through which a cooling medium is capable of flowing. The heat radiation fins 12 may radiate heat absorbed from the cooling medium through the passage member 10. The passage member 10 may be used as the heat exchanger 9. The heat radiation fins 12 may be used as a heat radiation portion in the heat exchanger 9. Therefore, the heat exchanger 9 having a high cooing capacity can be obtained. The heat radiation fins 12 may be used as a heat absorption portion in the heat exchanger 9.

Second Embodiment

Figure 12:
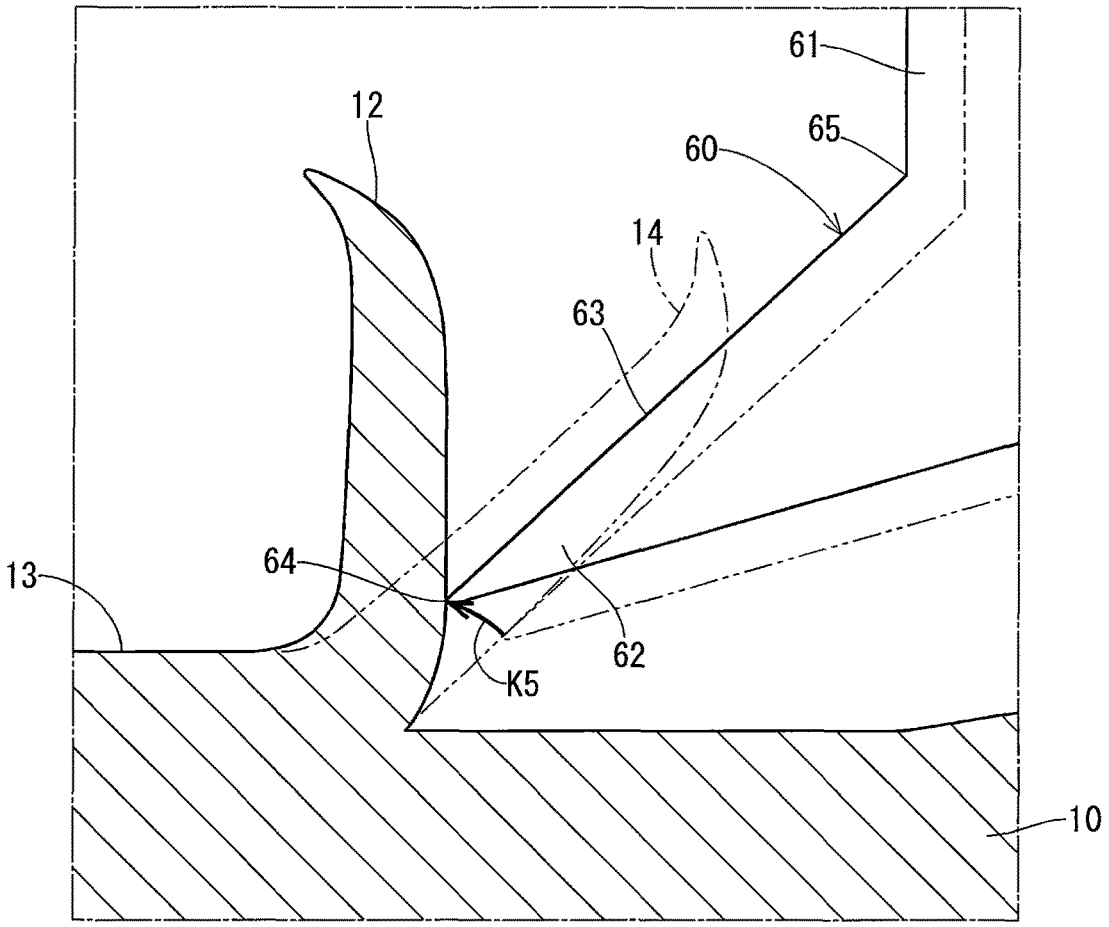
FIG. 12 is a diagram showing tool bits moved along a second forming pathway in a protrusion forming device according to a second embodiment of the present disclosure.

A protrusion forming device according to a second embodiment of the present disclosure will be described with reference to FIG. 12. The protrusion forming device of the second embodiment includes a drive portion capable of displacing tool bits 60 along a second forming pathway K5. A start point of the second forming pathway K5 is located at a position that is away from a base end portion of a cut part 14 (protrusion part), and is located between the base end portion and an edge portion of the cut part 14 as shown in FIG. 12. The second forming pathway K5 extends in a circumferential direction of a circle that is drawn by using the base end portion of the cut part 14 as a center. In other words, the second forming pathway K5 extends in a direction intersecting with the cut part 14. When the tool bit 60 moves along the second forming pathway K5, the base end portion of the cut part 14 is pressed and bent so that the cut part 14 is formed to be the heat radiation fin 12 that extends perpendicular to an outer surface 13 of a passage member 10.

In the second embodiment, effects similar to effects of the first embodiment can be obtained. Additionally, a curvature of the base end portion of the cut part 14 can be made to be gentle in the second embodiment. Therefore, it can be restricted that the cut part 14 breaks from its base end portion when the cut part 14 is bent and raised up.

Third Embodiment

Figure 13:
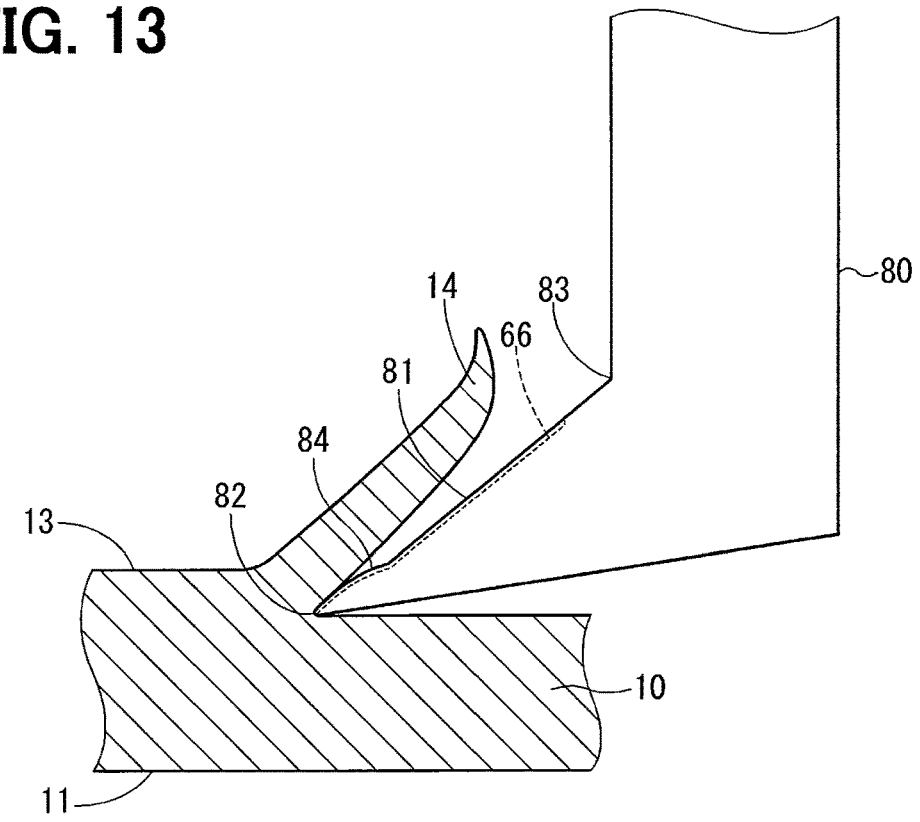
FIG. 13 is a diagram showing a cutting portion of a tool bit according to a third embodiment of the present disclosure.

A tool bit 80 of a protrusion forming device according to a third embodiment of the present disclosure will be described referring to FIG. 13. As shown in FIG. 13, a rake face 81 of the tool bit 80 has a curve surface 84 extending from an edge 82 of the tool bit 80 toward a base end 83 of the tool bit 80 in a direction away from the cut part 14. Specifically, the curve surface 84 is protruded from the rake face 81 toward the cut part 14, and an end part of the curve surface 84 is located at the edge 82 to contact the cut part 14. The other end part of the curve surface 84 is distant from the cut part 14.

In the third embodiment, effects similar to effects of the first embodiment can be obtained. Additionally, a contact area between the tool bit 80 and the cut part 14 is relatively small, and a bending moment applied on the cut part 14 can be made to be relatively small in the third embodiment. Therefore, the cut part 14 obtained by the cutting work can be made to be further linear, and a cooling capacity of a heat radiation fin 12 (cut part) can be increased.

Fourth Embodiment

Figure 14:
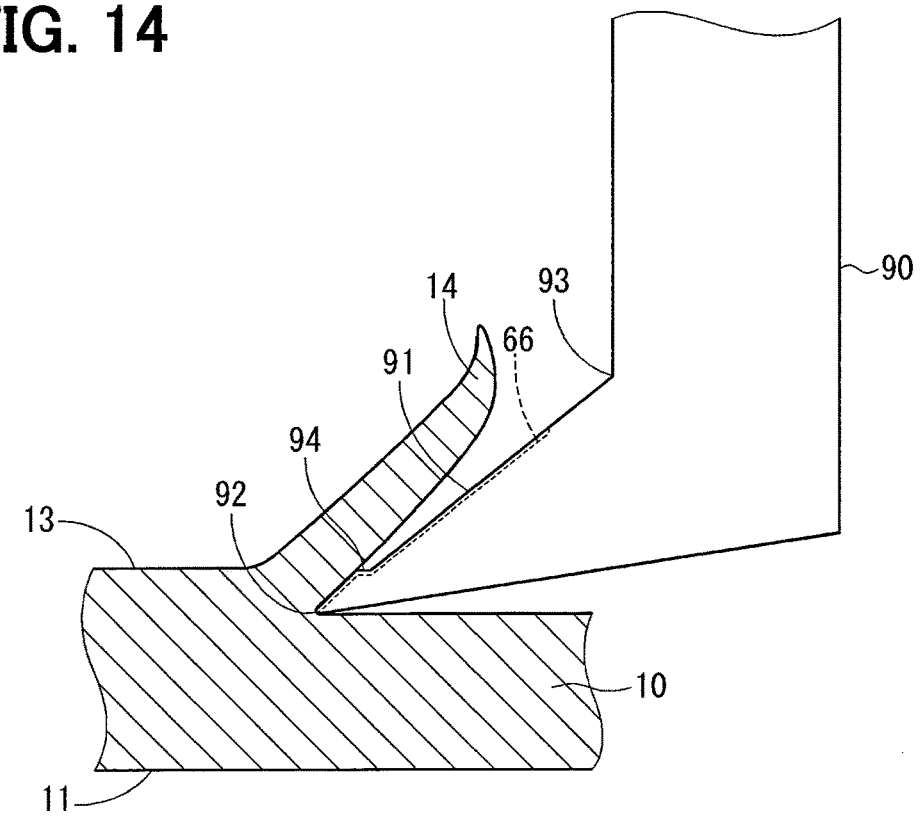
FIG. 14 is a diagram showing a cutting portion of a tool bit according to a fourth embodiment of the present disclosure.

A tool bit 90 of a protrusion forming device according to a fourth embodiment of the present disclosure will be described in reference to FIG. 14. As shown in FIG. 14, in the fourth embodiment, a rake face 91 of the tool bit 90 has a step surface 94 that extends from an edge 94 of the tool bit 90 toward a base end 93 of the tool bit 90 in a direction away from a cut part 14. A part of the rake face 91 between the edge 92 and the step surface 94 contacts the cut part 14, and the other part of the rake face 91 between the base end 93 and the step surface 94 is distant from the cut part 14. Effects in the fourth embodiment are similar to those in the third embodiment.

Although the present disclosure has been fully described in connection with the preferred embodiments thereof with reference to the accompanying drawings, it is to be noted that various changes and modifications will become apparent to those skilled in the art. For example, the protrusion parts may be formed in a processed object other than the passage member 10. The protrusion parts may be used for a purpose other than the heat radiation fins 12. The passage member 10 may be held by the vise 31 without being located horizontally.

The further-cut pathway K3 may extend in a direction other than the direction parallel to the outer surface 13 of the passage member 10. The extending direction of the cut-in pathway K2 may be inclined from the outer surface 13 at an angle other than 10°.

The forming pathway may extend in a direction other than the direction perpendicular to the outer surface 13 of the passage member 10. The forming pathway may extend along a straight line perpendicular to the cut part 14, or may extend along a straight line inclined from the cut part 14.

A size of the tool bit 60, 80, 90 in its width direction may be enlarged, and the toll bit may form a protrusion part having a platy shape. The actuators 40, 50 carrying the tool bit 60, 80, 90 are not limited to the actuators in that the ball screws are rotary-driven by using motors. Another known actuator may be used as the actuators 40, 50. In other words, an actuator capable of displacing the tool bit in a flat plane parallel to the x-axial direction and the y-axial direction can be used as the actuators 40, 50.

The drive portion may include, for example, mechanical components that do not require an electronic control, instead of the two actuators 40, 50 and the electronic control device 70.

In the first embodiment, the rake face 63, 81, 91 has three grooves which are parallel to each other. Here, the number of grooves may be one, two or four. Moreover, the grooves may not be parallel to each other.

The rake face 63, 81, 91 may not include the grooves. In the first embodiment, the three tool bits 60, 80, 90 are connected to each other integrally. Alternatively, one, two or four tool bits 60, 80, 90 may be connected to each other integrally.

The protrusion forming device may be configured to form a protrusion part by using a single tool bit 60, 80, 90. The number of the cutting tools 67 made of multiple tool bits 60, 80, 90 may be equal to or lower than three, or may be equal to or higher than five.

The edges 64, 82, 92 of the tool bits 60, 80, 90 of one of the cutting tools 67 may overlap the edges 64, 82, 92 of the tool bits 60, 80, 90 of another one of the cutting tools 67 in the arrangement direction of the cutting tools 67. The present disclosure is not limited to the above-described embodiments, and is feasible in various states without departing from the scope of the disclosure.

Additional advantages and modifications will readily occur to those skilled in the art. The disclosure in its broader terms is therefore not limited to the specific details, representative apparatus, and illustrative examples shown and described.

What is claimed is:

1. A method for forming a protrusion part extending perpendicular to an outer surface of an object that is to be processed, the method comprising:

moving a tool bit along a cut-in pathway intersecting with the outer surface of the object so that a cutting portion of the tool bit is inserted into the object;

further moving the cutting portion inserted into the object along a further-cut pathway parallel to the outer surface of the object so as to form the protrusion part that is cut in a linear shape and is connected to the object; and further moving the tool bit along a predetermined forming pathway to form the protrusion part extending perpendicular to the outer surface of the object while keeping the tool bit in contact with the protrusion part.

2. The forming method according to claim 1, wherein the forming pathway starts from a position contacting a base end portion of the protrusion part, the forming pathway extends in a direction away from the outer surface of the object, and the tool bit slides on and bends the protrusion part when the tool bit is moved along the forming pathway.

3. The forming method according to claim 1, wherein the forming pathway starts from a position that is away from a base end portion of the protrusion part and is located between the base end portion and an edge portion of the protrusion part, the forming pathway extends in a direction intersecting with the protrusion part, and the tool bit presses and bends the protrusion part when the tool bit is moved along the forming pathway.

4. The forming method according to claim 1, wherein the protrusion part is used as a heat radiation fin that radiates heat of the object.

5. The forming method according to claim 1, wherein the protrusion part is used as a heat radiation portion or a heat absorption portion in a heat exchanger.

6. A method for forming a protrusion part extending perpendicular to an outer surface of an object that is to be processed, the method comprising:

moving a tool bit along a cut-in pathway intersecting with the outer surface of the object so that a cutting portion of the tool bit is inserted into the object;

further moving the cutting portion inserted into the object along a further-cut pathway parallel to the outer surface of the object so as to form the protrusion part that is cut in a linear shape and is connected to the object; and further moving the tool bit along a predetermined forming pathway to form the protrusion part extending perpendicular to the outer surface of the object while keeping the tool bit in contact with the protrusion part, wherein the forming pathway starts at a contact point on the protrusion part, the contact point being away from a base end portion of the protrusion part and located between the base end portion and an edge portion of the protrusion part, the forming pathway extends in a direction intersecting with the protrusion part, and the tool bit presses only one side of the protrusion part and bends the protrusion part while maintaining contact with the contact point on the protrusion part as the tool bit moves along the forming pathway.

* * * * *